US009849394B1

(12) United States Patent
Shindo

(10) Patent No.: US 9,849,394 B1
(45) Date of Patent: Dec. 26, 2017

(54) TOY TOP SET AND LAUNCHER

(71) Applicant: TOMY COMPANY, LTD., Tokyo (JP)

(72) Inventor: Yukihiro Shindo, Tokyo (JP)

(73) Assignee: TOMY COMPANY, LTD., Katsushika-Ku, Tokyo (JP)

( * ) Notice: Subject to any disclaimer, the term of this patent is extended or adjusted under 35 U.S.C. 154(b) by 0 days.

(21) Appl. No.: 15/673,169

(22) Filed: Aug. 9, 2017

(30) Foreign Application Priority Data

Sep. 5, 2016 (JP) ..... 2016-172640

(51) Int. Cl.
*A63H 1/02* (2006.01)
*A63F 9/16* (2006.01)
*A63H 29/24* (2006.01)

(52) U.S. Cl.
CPC ..... *A63H 1/02* (2013.01); *A63F 9/16* (2013.01); *A63H 29/24* (2013.01)

(58) Field of Classification Search
CPC ... A63H 1/00; A63H 1/02; A63H 1/04; A63H 1/06; A63H 1/18; A63H 29/24; A63F 9/00; A63F 9/16
USPC ..... 446/256–266
See application file for complete search history.

(56) References Cited

U.S. PATENT DOCUMENTS

2003/0064660 A1* 4/2003 Matsukawa ..... A63F 3/00895 446/256
2011/0177750 A1* 7/2011 Ujita ..... A63H 1/04 446/263
2011/0256794 A1* 10/2011 Horikoshi ..... A63H 1/04 446/259

FOREIGN PATENT DOCUMENTS

JP S6391466 U 6/1988

OTHER PUBLICATIONS

Notice of Allowance dated Apr. 18, 2017 in Japanese Patent Application No. 2016-172640, 5 pages.

* cited by examiner

*Primary Examiner* — Kien Nguyen
(74) *Attorney, Agent, or Firm* — Shook, Hardy & Bacon L.L.P.

(57) ABSTRACT

A toy top includes a pinion gear and a locking portion. A launcher includes a rack belt and a holder. The rack belt includes an elastically deformable belt portion on which rack teeth capable of intermeshing with the pinion gear are formed. The toy top is set to the holder by intermeshing the rack teeth with the pinion gear. A rotational force is then applied to the toy top by pulling the rack belt to rotate the pinion gear. A space is formed in the holder, which is disposed in a vicinity of an intermeshing portion of the rack teeth and the pinion gear. The space allows deformation of the belt portion so that the belt portion previously attached to the holder does not interrupt setting the toy top to the holder.

7 Claims, 6 Drawing Sheets

TOY TOP SET AND LAUNCHER

CROSS-REFERENCE TO RELATED APPLICATIONS

This U.S. Non-Provisional Patent Application claims priority to co-pending Japanese Patent Application No. 2016-172640, filed Sep. 5, 2016, and titled "TOY TOP SET AND LAUNCHER," the contents of which are incorporated herein by reference in the entirety.

FIELD OF THE INVENTION

The present invention relates to a toy top set and a launcher.

BACKGROUND

Among toy top sets composed of a toy top and a launcher (toy top launching device), the one described in Japanese Utility Model Publication No. 563-91466A (microfilm of Japanese Utility Model Application No. S61-187193) has been known in the art. The toy top of the toy top set includes a pinion gear that is disposed on an input shaft having the same center axis with a rotation shaft and a locking portion that is disposed directly above the pinion gear on the input shaft and that protrudes outward in the radial direction of the input shaft to an extent approximately equal to the tooth tips of the pinion gear.

Further, the launcher includes a rack belt and a holder. The rack belt includes an elastic belt portion and rack teeth formed on one face of the belt portion. The holder is configured to hold the toy top such that the pinion gear intermeshes with the rack teeth directly below the locking portion of the toy top, and the belt portion thereby supports the locking portion from below. In the condition in which the toy top is held by the holder, when the rack belt is pulled in a predetermined direction, the pinion gear that intermeshes with the rack teeth is rotated to apply a rotational force to the toy top while the intermeshing of the pinion gear and the rack teeth is released so that the toy top is released from the holder.

The holder of the toy top set of JP S63-91466A has a U-shaped portion in the tip. Specifically, the tip of the holder includes upper and lower parallel plates that protrude horizontally in the operating position and a coupling portion that couples the upper and lower parallel plates with each other at their proximal ends. The inner surface of the coupling portion serves as a flat band guide face. The band guide face extends in the predetermined direction of the rack belt and is located in the part of the U-shaped portion that is opposed to the pinion gear. The band guide face is configured to abut the back face of the belt portion of the rack belt so as to guide the rack teeth to the intermeshing position with the pinion gear teeth and to maintain the intermeshed condition of the rack teeth and the pinion gear teeth.

However, the toy top set of JP 563-91466A is configured such that the pinion gear completely intermeshes with the rack teeth when the back face of the belt portion is in contact with the part of the band guide face opposed to the pinion gear. Therefore, the toy top cannot be set to the holder after the rack belt is attached to the holder.

Specifically, if an attempt is made to set the toy top to the holder after the rack belt is attached to the holder, the pinion gear cannot intermesh with the rack teeth since the locking portion abuts the belt portion in the course of the setting.

Therefore, in the toy top of JP S63-91466, it is necessary to insert the rack belt into the U-shaped portion with one hand while holding the toy top with the other hand in a position in which the rotation shaft of the toy top is inserted in a pinion gear insertion hole that is formed in the lower parallel plate, so as to intermesh the pinion gear with the rack teeth below the locking portion of the toy top. As a result, it has been troublesome to set the toy top to the holder.

SUMMARY OF THE INVENTION

The present invention has been made in view of the above-described problem, and an object thereof is to provide an easy-to-use launcher and a toy top set with the launcher.

According to a first aspect of the present invention, there is provided a toy top set, including: a toy top comprising a pinion gear which is disposed on an input shaft disposed on a body portion and having a same center axis with a rotation shaft, and a locking portion which is disposed directly above the pinion gear on the input shaft and which protrudes outward in a radial direction over a valley of the pinion gear; and a launcher comprising a rack belt comprising an elastically deformable belt portion on which rack teeth capable of intermeshing with the pinion gear are formed, and a holder to which the rack belt is attached, wherein the launcher is configured to launch the toy top such that the toy top is set to the holder by intermeshing the rack teeth with the pinion gear below the locking portion so as to fit the belt portion below the locking portion, a rotational force is then applied to the toy top by pulling the rack belt in a predetermined direction to rotate the pinion gear, and subsequently the intermeshing of the pinion gear and the rack teeth is released, wherein a space is formed in the holder, which is disposed in a vicinity of an intermeshing portion of the rack teeth and the pinion gear and which allows elastic deformation of the belt portion so that the belt portion of the rack belt previously attached to the holder does not interrupt setting the toy top to the holder, and wherein the holder comprises a belt guide which is configured to be in contact with an opposite face from the rack teeth of the belt portion to guide the belt portion so that the pinion gear and the rack teeth intermesh with each other by means of elasticity of the belt portion.

According to a second aspect of the present invention, there is provided a launcher used for a toy top which comprises a pinion gear which is disposed on an input shaft disposed on a body portion and having a same center axis with a rotation shaft, and a locking portion which is disposed directly above the pinion gear on the input shaft and which protrudes outward in a radial direction over a valley of the pinion gear, including: a rack belt comprising an elastically deformable belt portion on which rack teeth capable of intermeshing with the pinion gear are formed; and a holder to which the rack belt is attached, wherein the launcher is configured to launch the toy top such that the toy top is set to the holder by intermeshing the rack teeth with the pinion gear below the locking portion so as to fit the belt portion below the locking portion, a rotational force is then applied to the toy top by pulling the rack belt in a predetermined direction to rotate the pinion gear, and subsequently the intermeshing of the pinion gear and the rack teeth is released, wherein a space is formed in the holder, which is disposed in a vicinity of an intermeshing portion of the rack teeth and the pinion gear and which allows elastic deformation of the belt portion so that the belt portion of the rack belt previously attached to the holder does not interrupt setting the toy top to the holder, and wherein the holder comprises a belt guide which is configured to be in contact with an opposite face from the rack teeth of the belt portion to guide the belt portion so that the pinion gear and the rack teeth intermesh with each other by means of elasticity of the belt portion.

According to such configuration, it is possible to set the toy top to the holder afterward by elastically deforming the belt portion while keeping the rack belt attached to the holder. Therefore, it is easy to handle the launcher.

Preferably, the space in the holder is formed next to the intermeshing portion of the rack teeth and the pinion gear to allow the belt portion to retract outward in a radial direction of the locking portion such that the belt portion of the rack belt which is previously attached to the holder does not overlap the locking portion in a vertical direction.

According to such configuration, it is possible to set the toy top to the holder afterward by retracting the belt portion while keeping the rack belt attached to the holder. Therefore, it is easy to handle the launcher.

Preferably, an upper face periphery of the locking portion of the toy top is formed in a beveled shape which expands in diameter toward a lower side.

According to such configuration, since the upper face of the locking portion of the toy top is formed in a bevel shape that expands in diameter toward the lower end, the belt portion is pushed by the beveled portion to retract outward from the locking portion when the toy top is pressed against the holder while keeping the rack belt attached to the holder. Therefore, it is easy to set the toy top to the holder.

Preferably, the toy top is positioned relative to the holder by fitting a protrusion and a recess, the protrusion being formed on one of the toy top and the holder, and the recess being formed on another of the toy top and the holder.

More preferably, the recess is formed in an upper face of the locking portion of the toy top, and the protrusion is formed on the holder.

According to such configuration, it is possible to position the toy top by fitting the protrusion into the recess in the vertical direction. Therefore, it is easy to set the toy top to the holder.

BRIEF DESCRIPTION OF THE DRAWINGS

The present invention will become more fully understood from the detailed description given hereinbelow and the appended drawings which are given by way of illustration only, and thus are not intended as a definition of the limits of the present invention, and wherein:

FIG. 6A to FIG. 6C illustrate the relationship between a pinion gear and a rack belt of the toy top set of FIG. 1, in which FIG. 6A illustrates the relationship between the pinion gear and the rack belt before the toy top is set, FIG. 6B illustrates the relationship between the pinion gear and the rack belt in the course of setting the toy top, and FIG. 6C illustrates the relationship between the pinion gear and the rack belt after the toy top is completely set;

FIG. 7A and FIG. 7B illustrate the function of a chamber of the toy top set of FIG. 1, in which FIG. 7A illustrates the state of the rack belt in the course of setting the toy top, and FIG. 7B illustrates the state of the rack belt after the toy top is completely set; and FIG. 8A to FIG. 8C illustrate the relationship between a pinion gear and a rack belt of a toy top set according to a second embodiment of the present invention, in which FIG. 8A illustrates the relationship between the pinion gear and the rack belt before the toy top is set, FIG. 8B illustrates the relationship between the pinion gear and the rack belt in the course of setting the toy top, and FIG. 8C illustrates the relationship between the pinion gear and the rack belt after the toy top is completely set.

DETAILED DESCRIPTION

Hereinafter, an embodiment of the present invention will be described with reference to the drawings. Though various technical limitations which are preferable to perform the present invention are included in the embodiment, the scope of the invention is not limited to the embodiment and the illustrated examples.

First Embodiment

Figure 1:
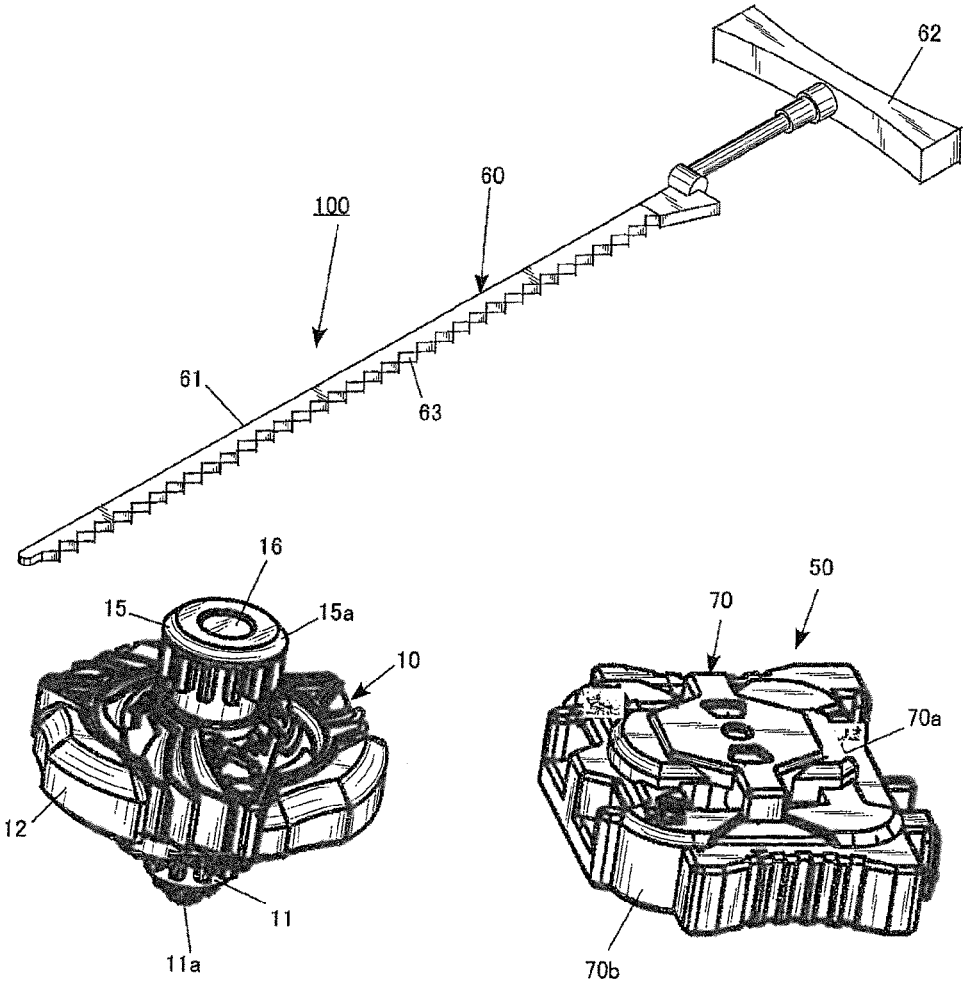
FIG. 1 is a perspective view of a toy top set according to a first embodiment of the present invention.

FIG. 1 is a perspective view of a toy top set, illustrating the appearance thereof.

The toy top set 100 includes a toy top 10 and a launcher 50.

The toy top 10 is configured to enable disassembly into several portions in the vertical direction. The toy top 10 roughly includes a shaft portion 11, a body portion 12 and an input shaft 13.

The shaft portion 11 is formed in an approximately reversed conical shape with a diameter that reduces stepwise toward a lower rotation shaft 11*a*. The rotation shaft 11*a* is located at the center of the shaft portion 11.

The body portion 12 is formed in a disk shape, and an uneven pattern is formed in the outer periphery. The uneven pattern can give variation to a battle game.

Figure 2:
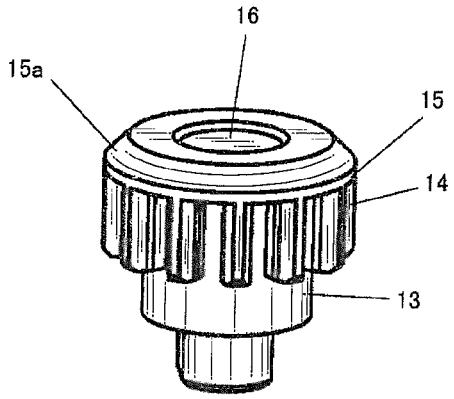
FIG. 2 is a perspective view of an input shaft of the toy top set of FIG. 1.

The input shaft 13 has the same center axis with the rotation shaft 11*a*. As illustrated in FIG. 2, a pinion gear 14 is formed on the input shaft 13, which has the same center axis as the input shaft 13. Directly above the pinion gear 14, a locking portion 15 is formed on the input shaft 13, which protrudes to the tooth tips of the pinion gear 14 to cover the valleys of pinion gear 14 from above. An upper face periphery 15*a* of the locking portion 15 is formed in a beveled shape so that the diameter expands toward the lower side. The upper end of the input shaft 13 is formed in a flat shape, and a round hole 16 is formed at the center thereof. The hole 16 is provided to position the toy top 10.

The launcher 50 is composed of a rack belt 60 and a holder 70.

The rack belt 60 includes a belt portion 61 and an operation portion 62.

The belt portion 61 is formed in a band shape, and rack teeth 63 are formed on one face thereof. Further, the belt portion 61 is elastically deformable at least in the protruding direction of the rack teeth 63.

The operation portion 62 is provided in the proximal end of the belt portion 61, which protrudes in both sides in the direction of the teeth height of the rack teeth 63. The operation portion 62 is operable, for example, by hooking the index finger on one protrusion and the middle finger on the other protrusion.

Figure 3:
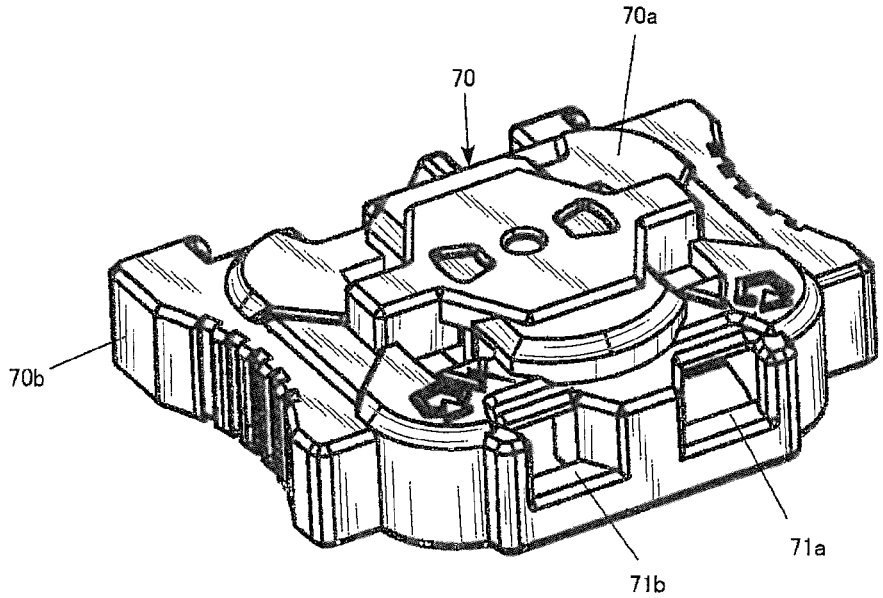
FIG. 3 is a perspective view of a holder of the toy top set of FIG. 1 from a certain direction.
Figure 4:
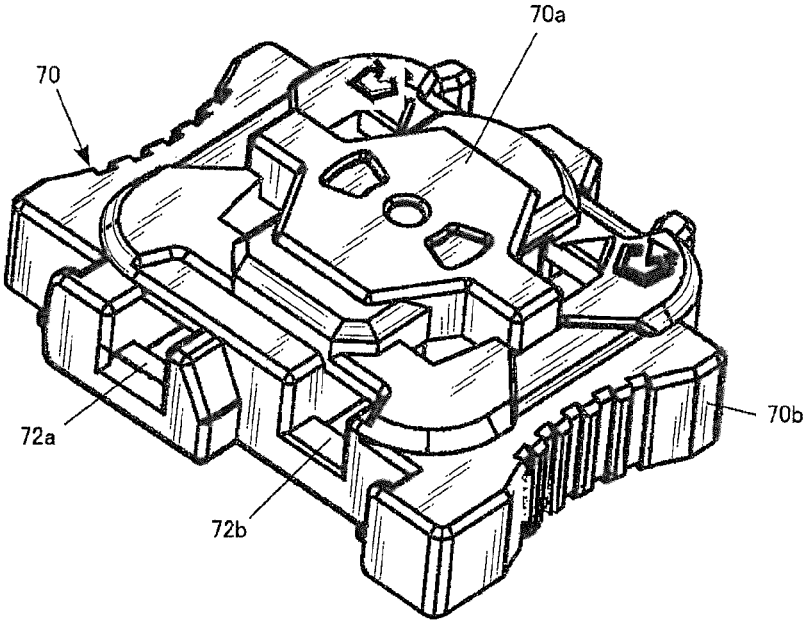
FIG. 4 is a perspective view of the holder of the toy top set of FIG. 1 from another direction.

The holder 70 is formed in a size that can be held in one hand. As illustrated in FIG. 3 and FIG. 4, the holder 70 has such a shape that a vertical side wall 70*b* is provided along the outer edge of a surface plate 70*a* having an approximately rectangular shape in a plan view. The surface plate 70*a* and the side wall 70*b* define a hollow that is open downward.

As illustrated in FIG. 3, on one side of the side wall 70*b* of the holder 70, two insertion openings 71*a*, 71*b* are formed at a predetermined distance from each other in the width direction of the holder 70. Both of the insertion openings 71*a*, 71*b* are in communication with the inner hollow of the holder 70. The insertion openings 71*a*, 71*b* are provided to allow insertion and removal of the rack belt 60. Further, on the opposite side of the holder 70, two outlet openings 72*a*, 72*b* are formed at a predetermined distance from each other in the width direction as illustrated in FIG. 4. Both of the outlet openings 72*a*, 72*b* are in communication with the inner hollow of the holder 70. The outlet openings 72*a*, 72*b* are provided to guide out the tip of the rack belt 60 when the rack belt 60 is inserted.

Figure 5:
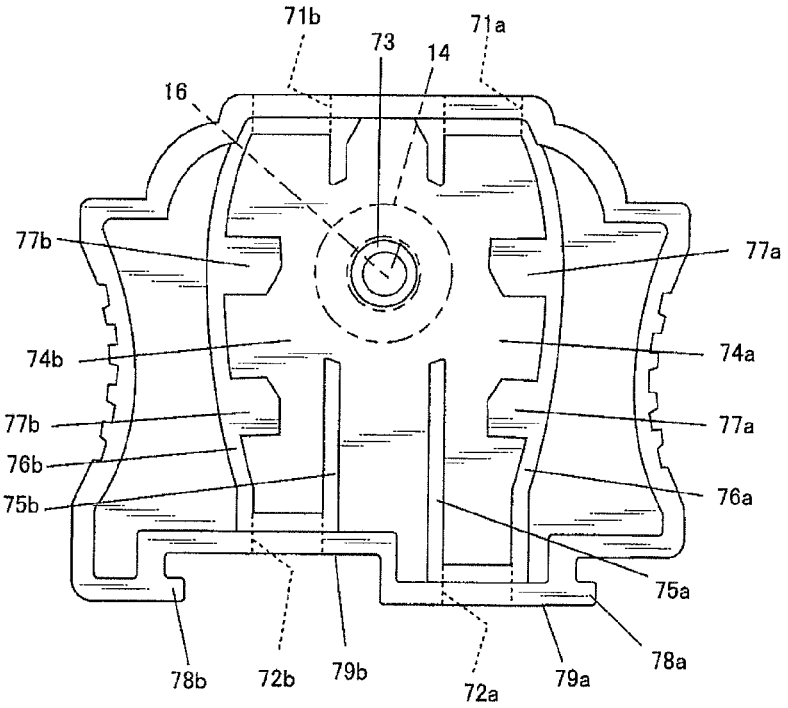
FIG. 5 is a bottom view of the holder of the toy top set of FIG. 1.

As illustrated in FIG. 5, a receiver 73 for the toy top 10 is formed on the inner side of the holder 70. The receiver 73 is in the shape of a cylindrical protrusion. The receiver 73 is formed in a size that can be inserted in the hole 16 of the toy top 10. On the inner face of the holder 70, a pathway 74*a* connecting the insertion opening 71*a* to the outlet opening 72*a* and a pathway 74*b* connecting the insertion opening 71*b* to the outlet opening 72*b* are formed.

The pathway 74*a* is defined by an inner wall 75*a* proximal to the receiver 73 and an outer wall 76*a* distal to the receiver 73. The inner wall 75*a*, which has a straight shape, is not present in the part opposed to the receiver 73. The outer wall 76*a* has a curved portion that bulges outward in the width direction in an arc shape. Further, at the lower end of the outer wall 76*a*, two support pieces 77*a* are formed in a predetermined distance from each other, which are configured to support the belt portion 61 from below. Among them, the rim of the insertion opening 71*a*, the rim of the outlet opening 72*a* and the straight part of the outer wall 76*a* function as a belt guide for intermeshing the pinion gear 14 and the rack teeth 63 with each other. It is only required that the belt guide is configured to be in contact with the opposite face (back face) from the rack teeth 63 of the belt portion 61 so as to intermesh the pinion gear 14 and the rack teeth 63 with each other by means of the elasticity of the belt portion 61, and the position, the number and the shape thereof are not limited.

The pathway 74*b* is defined by an inner wall 75*b* proximal to the receiver 73 and an outer wall 76*b* distal to the receiver 73. The inner wall 75*b*, which has a straight shape, is not present in the part opposed to the receiver 73. The outer wall 76*b* has a curved portion that bulges outward in the width direction in an arc shape. Further, at the lower end of the outer wall 76*b*, two support pieces 77*b* are formed in a predetermined distance from each other, which are configured to support the belt portion 61 from below. Among them, the rim of the insertion opening 71*b*, the rim of the outlet opening 72*b* and the straight part of the outer wall 76*b* function as a belt guide that makes the pinion gear 14 and the rack teeth 63 intermesh with each other. It is only required that the belt guide is configured to be in contact with the back face of the belt portion 61 so as to intermesh the pinion gear 14 and the rack teeth 63 with each other by means of the elasticity of the belt portion 61, and the position, the number and the shape thereof are not limited.

The holder 70 with the above-described configuration is configured such that two holders can be coupled with their backs to each other.

That is, in the side where the outlet openings 72*a*, 72*b* are formed, the holder 70 protrudes outward around the outlet opening 72*a* and recesses inward around the outlet opening 72*b*. A hook 78*a* is formed on the outer wall of the protrusion 79*a*, and a hook 78*b* is formed on the inner wall of the recess 79*b*. Two holders 70, 70 can be coupled to each other by aligning the protrusion 79*a* and the recess 79*b* of one holder 70 respectively with the recess 79*b* and the protrusion 79*a* of the other holder 70 and fitting them to each other from the vertical direction. By using the two holders 70, 70 thus coupled, it is possible to launch two toy tops 10 at the same time. In this case, the rack belt 60 may be inserted into the insertion opening 71*a* or 71*b* of any one of the coupled two holders 70, 70. Then, the insertion opening 71*a* or the insertion opening 71*b* of the other holder 70 serves as an outlet opening of the rack belt 60.

Regardless of whether a single holder 70 or two coupled holders 70, 70 are used, it is possible to change the rotational direction of the toy top 10 by selecting which of the insertion opening 71*a* or the insertion opening 71*b* of the holder 70 is used.

Usage

Next, a usage of the toy top set 100 will be described. While the following description illustrates a case in which a single holder 70 is used, the usage is almost identical in a case in which two holders 70, 70 are used.

Figure 6A:
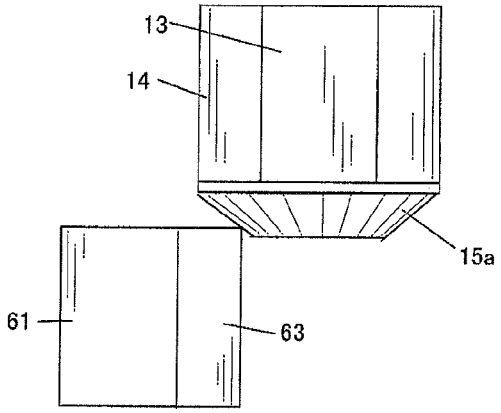
Figure 6B:
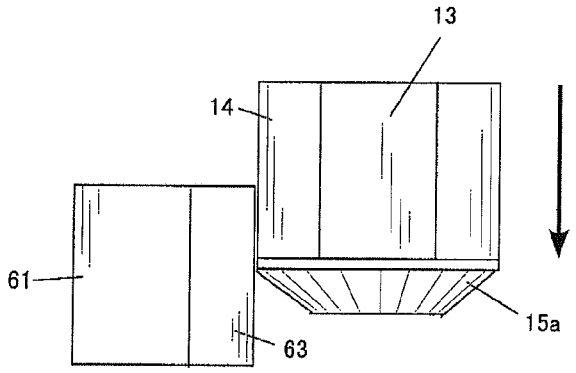
Figure 6C:
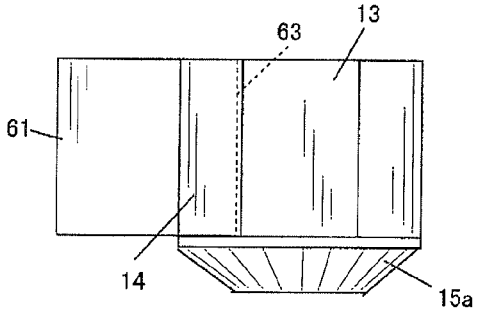
Figure 7A:
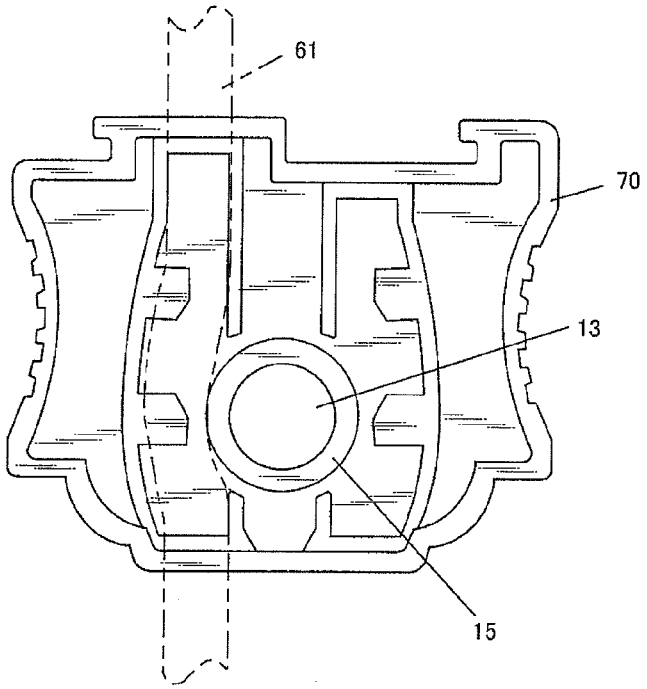
Figure 7B:
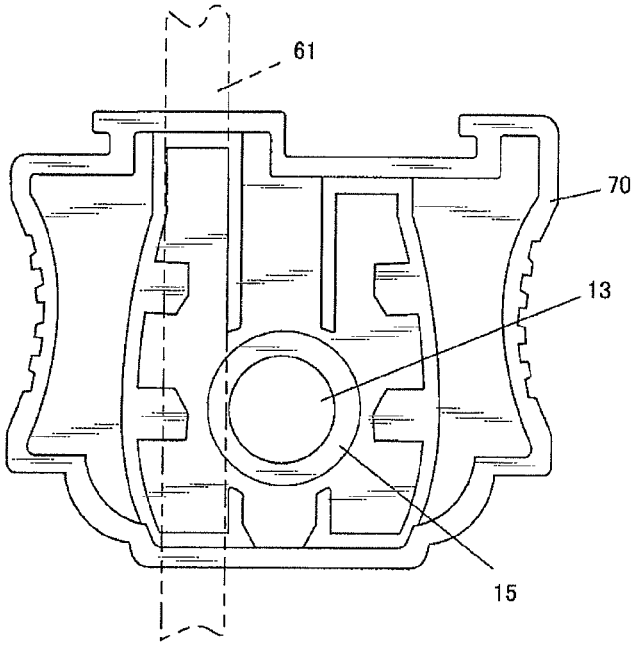

First, the tip of the rack belt 60 is aligned with the insertion opening 71*a*, and the belt portion 61 is inserted into the holder 70. In this condition, the tip of the belt portion 61 is guided out through the outlet opening 72*a* of the holder 70. Then, the hole 16 of the toy top 10 is aligned with the receiver 73 of the holder 70, and the toy top 10 is pushed in so that the receiver 73 is fitted in the hole 16 of the toy top 10. In this step, the beveled surface of the upper face periphery 15*a* of the locking portion 15 of the toy top 10 comes in contact with the rack teeth 63 of the belt portion 61 (FIG. 6A). As the toy top 10 is pushed in, the beveled surface of the upper face periphery 15*a* of the locking portion 15 pushes the rack teeth 63 outward (FIG. 6B and FIG. 7A). Then, when the receiver 73 fits in the hole 16 of the toy top 10, the belt portion 61 elastically returns to the original shape so that the rack teeth 63 and the pinion gear 14 intermesh with each other (FIG. 6C and FIG. 7B). As a result, the intermeshed portion of the rack teeth 63 and the pinion gear 14 is covered with the locking portion 15. This prevents the toy top 10 from detaching from the holder 70 even when the toy top 10 is positioned downward. In other words, the toy top 10 is held by the holder 70.

Then, the holder 70 is held in one hand, and the rack belt 60 is pulled with the other hand in the predetermined direction. This applies rotational force to the toy top 10. Then, once the tip of the belt portion 61 passes through the pinion gear 14, the toy top 10 loses the support of the locking portion 15, and the rotating toy top 10 detaches from the holder 70 by its own weight.

Advantageous Effects of Embodiments

The toy top set 100 is convenient since it is possible to set the toy top 10 to the holder 70 even with the rack belt 60 attached to the holder 70. In particular, since the upper face periphery 15*a* of the locking portion 15 is formed with a beveled surface, the rack belt 60 is deviated to the outer side of the pinion gear 14 of the toy top 10 just by pushing the beveled surface of the toy top 10 against the rack belt 60. Therefore, the toy top 10 can be set more readily.

Second Embodiment

Figure 8A:
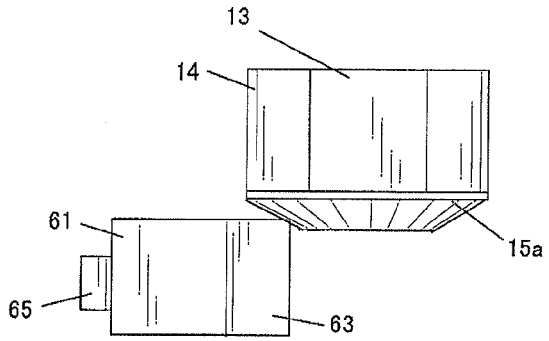
Figure 8B:
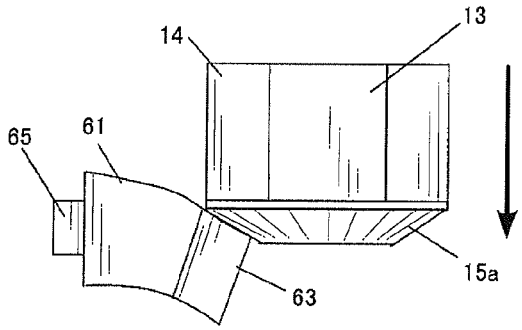
Figure 8C:
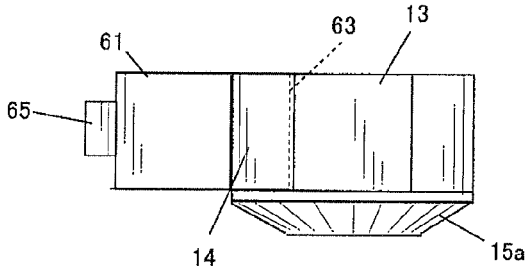

FIGS. 8A-8C illustrate a second embodiment. In the second embodiment, the belt portion 61 is elastically torsional. The belt portion 61 is twisted when the beveled surface pushes the belt portion 61 while the toy top 10 is set to the holder 70, (FIG. 8A and FIG. 8B). Thereafter, the pinion gear 14 and the rack teeth 63 intermesh with each other by means of the elasticity of the belt portion 61 (FIG. 8C). With this configuration, it is possible to set the toy top 10 to the holder 70 even after the rack belt 60 is attached to the holder 70. In FIG. 8, the reference sign 65 denotes a belt guide. The belt guide 65 is positioned so as not to reduce the space for torsion of the belt portion 61.

The space for deviation of the belt portion 61 is ensured only in the direction parallel to the axis of the locking portion 15 since the belt portion 16 is thin. In this case, the belt guide, which is configured to be in contact with the back face of the belt portion 61, may also be formed in the part opposed to the pinion gear 14 of the toy top 10 set in the holder 70.

The other portions are configured approximately the same as those of the first embodiment, and the illustration and the description thereof are omitted.

Variations

While embodiments of the present invention are described, the present invention is not limited to them, and a variety of changes may be made without departing from the features of the present invention.

For example, in the above-described embodiments, the portions curved in an arc shape are provided in the outer wall 76*a* defining the pathway 74*a* and the outer wall 76*b* defining the pathway 74*b*. However, such curved portions may be omitted since they are provided to ensure the space for deviation of the belt portion 61. That is, the only requirement is to have a space for deviation of the belt portion 61 that enables the toy top 10 to be set afterward.

In the above-described embodiments, in order to position the toy top 10, the hole (recess) 16 is provided in the toy top 10 while the receiver (protrusion) is provided in the holder 70. However, they may be interchanged with each other. Further, they may have any shape that enables positioning.

In the above-described embodiments, the upper face periphery of the locking portion 15 has a beveled surface. However, it may not have a beveled surface. Particularly in the second embodiment, the belt portion 61 of the rack belt 60 can be twisted by butting the pinion gear 14 even when the upper face is flat.

In the above-described embodiments, the belt portion 61 of the rack belt 60 is deformed by butting the pinion gear 14. Instead, the belt portion 61 may be deformed manually by a user with his/her hand or a tool.

This U.S. Non-Provisional Patent Application claims priority to co-pending Japanese Patent Application No. 2016-172640, filed Sep. 5, 2016, the entire contents of which are incorporated by reference herein for correction of any incorrect translation.

What is claimed is:

1. A toy top set, comprising:

a toy top comprising a pinion gear which is disposed on an input shaft disposed on a body portion and having a same center axis with a rotation shaft, and a locking portion which is disposed directly above the pinion gear on the input shaft and which protrudes outward in a radial direction over a valley of the pinion gear; and a launcher comprising a rack belt comprising an elastically deformable belt portion on which rack teeth capable of intermeshing with the pinion gear are formed, and a holder to which the rack belt is attached, wherein the launcher is configured to launch the toy top such that the toy top is set to the holder by intermeshing the rack teeth with the pinion gear below the locking portion so as to fit the belt portion below the locking portion, a rotational force is then applied to the toy top by pulling the rack belt in a predetermined direction to rotate the pinion gear, and subsequently the intermeshing of the pinion gear and the rack teeth is released, wherein a space is formed in the holder, which is disposed in a vicinity of an intermeshing portion of the rack teeth and the pinion gear and which allows elastic deformation of the belt portion so that the belt portion of the rack belt previously attached to the holder does not interrupt setting the toy top to the holder, and wherein the holder comprises a belt guide which is configured to be in contact with an opposite face from the rack teeth of the belt portion to guide the belt portion so that the pinion gear and the rack teeth intermesh with each other by means of elasticity of the belt portion.

2. The toy top set according to claim 1, wherein the space in the holder is formed next to the intermeshing portion of the rack teeth and the pinion gear to allow the belt portion to retract outward in a radial direction of the locking portion such that the belt portion of the rack belt which is previously attached to the holder does not overlap the locking portion in a vertical direction.

3. The toy top set according to claim 1, wherein an upper face periphery of the locking portion of the toy top is formed in a beveled shape which expands in diameter toward a lower side.

4. The toy top set according to claim 1, wherein the toy top is positioned relative to the holder by fitting a protrusion and a recess, the protrusion being formed on one of the toy top and the holder, and the recess being formed on another of the toy top and the holder.

5. The toy top set according to claim 4, wherein the recess is formed in an upper face of the locking portion of the toy top, and the protrusion is formed on the holder.

6. A launcher used for a toy top which comprises a pinion gear which is disposed on an input shaft disposed on a body portion and having a same center axis with a rotation shaft, and a locking portion which is disposed directly above the pinion gear on the input shaft and which protrudes outward in a radial direction over a valley of the pinion gear, comprising:

a rack belt comprising an elastically deformable belt portion on which rack teeth capable of intermeshing with the pinion gear are formed; and a holder to which the rack belt is attached, wherein the launcher is configured to launch the toy top such that the toy top is set to the holder by intermeshing the rack teeth with the pinion gear below the locking portion so as to fit the belt portion below the locking portion, a rotational force is then applied to the toy top by pulling the rack belt in a predetermined direction to rotate the pinion gear, and subsequently the intermeshing of the pinion gear and the rack teeth is released, wherein a space is formed in the holder, which is disposed in a vicinity of an intermeshing portion of the rack teeth and the pinion gear and which allows elastic deformation of the belt portion so that the belt portion of the rack belt previously attached to the holder does not interrupt setting the toy top to the holder, and wherein the holder comprises a belt guide which is configured to be in contact with an opposite face from the rack teeth of the belt portion to guide the belt portion so that the pinion gear and the rack teeth intermesh with each other by means of elasticity of the belt portion.

7. The launcher according to claim 6, wherein the space in the holder is formed next to an intermeshing portion of the rack teeth and the pinion gear to allow the belt portion to retract outward in a radial direction of the locking portion such that the belt portion of the rack belt which is previously attached to the holder does not overlap the locking portion in a vertical direction.

* * * * *